US005750944A

United States Patent [19]

Fuchs

[11] Patent Number: 5,750,944

[45] Date of Patent: May 12, 1998

[54] FOIL SOUND ABSORBERS

[75] Inventor: Helmut Fuchs, Weil, Germany

[73] Assignee: Fraunhofer-Gesellschaft zur Foerderung der angewandten Forschung e.V., Munich, Germany

[21] Appl. No.: 704,715

[22] PCT Filed: Mar. 13, 1995

[86] PCT No.: PCT/DE95/00341

§ 371 Date: Nov. 18, 1996

§ 102(e) Date: Nov. 18, 1996

[87] PCT Pub. No.: WO95/25325

PCT Pub. Date: Sep. 21, 1995

[30] Foreign Application Priority Data

Mar. 15, 1994 [DE] Germany ..... 44 08 782.9

[51] Int. Cl.[6] ..... E04B 1/82

[52] U.S. Cl. ..... 181/290; 181/286; 181/295

[58] Field of Search ..... 181/295, 286, 181/30, 290

[56] References Cited

U.S. PATENT DOCUMENTS

| | | | |
|---|---|---|---|
| 4,425,981 | 1/1984 | Kiesewetter et al. . | |
| 4,555,433 | 11/1985 | Jablonka et al. . | |
| 4,607,466 | 8/1986 | Allred | 181/290 X |
| 4,703,374 | 10/1987 | Biermeier et al. . | |
| 4,780,777 | 10/1988 | Biermeier et al. . | |
| 4,832,147 | 5/1989 | Dear et al. | 181/286 X |

FOREIGN PATENT DOCUMENTS

| | | |
|---|---|---|
| 0 374 013 | 6/1990 | European Pat. Off. . |
| 0 523 429 | 1/1993 | European Pat. Off. . |
| 2 560 953 | 9/1985 | France . |
| 27 58 041 | 6/1979 | Germany . |
| 29 21 050 | 11/1980 | Germany . |
| 32 33 654 | 3/1984 | Germany . |
| 35 04 208 | 8/1986 | Germany . |
| 43 15 759 | 5/1994 | Germany . |

OTHER PUBLICATIONS

*Baupraxis & Dokumentation* 7, Mineralfasern Eine Gefahrenquelle Mit 35 Bildern und 610 Literaturstellan by Johann Koester et al.

*Acustica*, vol. 47, No. 2, 1981, Schallabsorber aus Kuntststoff–Folie, by von F. Mechel et al.

*Primary Examiner*—Khanh Dang

*Attorney, Agent, or Firm*—Evenson, McKeown, Edwards & Lenahan, P.L.L.C.

[57] ABSTRACT

A foil sound absorber consists of at least two smooth, flat and air-tight foils separated from each other and from a reverberant rear wall R by different distances D.

10 Claims, 10 Drawing Sheets

UNIFORM

NON-UNIFORM

FOIL SOUND ABSORBERS

BACKGROUND AND SUMMARY OF THE INVENTION

The present invention relates to a foil absorber for sound.

1. Introduction

The use of more or less homogeneous layers of fibrous/porous materials (e.g. synthetic mineral fibers (KMF)) predominate as seen in FIGS. 1A–C: in room acoustics (e.g. wall and ceiling cladding, FIG. 1*a*), in noise control of loud machines (e.g. cladding and screening) as well as in technological noise control (e.g. by means of sound dampers in flow canals, FIG. 1*c*). The discussions for many years about possible health risks from the fine dust and fibers (Koster, J.; Grunau, E.B.: Mineralfasern: Eine Gefahrenquelle, Expert-Verlag, Ehningen, 1993) as well as from deposits and germ infestation in such layers have led, on the one hand, to attempts to cover and wrap the porous material with suitable foils and nonwoven fabrics and, on the other hand, to seek alternative sound absorbers obviating the use of porous materials. This search soon led the assignee of the present invention to the development of three totally different absorbers for completely different acoustical applications ("Schallabsorbierendes Bauelement"—German patent document DE 27 58 041; "Schalldampfer Box"—German patent document DE 35 04 208 (corresponding to U.S. Pat. No. 4,787,473); and "schallabsorbierendes Glas—oder Kunstglas-Bauteil"—German patent document DE 43 15 759). These absorbers can, each individually and in combination, as well as as a supplement to enhance the performance of conventional absorbers, cover a broad frequency range of approximately 50 Hz up into the kHz range and a very wide field of applications. Moreover, there are also more or less successful attempts at describing these usually two-dimensionally designed absorbers.

For instance, in Mechel F.; Kiesewetter, N.; Schallabsorber aus Kunststoff-Folie. Acustica 47 (1981), pp. 83–88 shows that a plane plastic foil that is excited to propagate forced bending waves by a diagonally striking soundwave is unable to destroy a substantial part of the sound energy by means of internal friction. In order to, nonetheless, substantially raise the degree of dissipation, it has been proposed to deform the foil in such a manner that rectangular two-dimensional pieces of a few centimeters in length and width, which are bordered by a fold, are created. The fold at the edge of these plates acts like a fastening device and prevents free motion of the foil at this site. By this means, these plates are excited to characteristic vibrations. The wavelengths of these natural vibrations are in the frequency range up to 5000 Hz substantially smaller than the track wavelength of the incident airborne soundwave. The vibration amplitude of the plate is especially great in the case of natural frequencies. Due to the resonance-like co-vibration of the subareas with their characteristic bending vibrations, one thought if there continues to be relatively little internal dampening, but stronger deformation of the foil material, greater dampening of the excited soundwaves could be achieved at least in the vicinity of the natural frequency. In order to obtain a wideband sound absorber despite these profiled foils which are principally limited only functioning in narrow frequency bands, one solution described in "Schallabsorbierendes Baulelement" German patent document DE 29 21 050 (corresponding to U.S. Pat. No. 4,425,981), and "Schallabsorbierendes Bauelement"—German patent document DE 32 33 654 (corresponding to U.S. Pat. No. 4,555,433) tried:

(1) to create plates of varying size swedging in the bottom and lateral surfaces of the foils;

(2) to make a greater number of natural frequencies excitable within one and the same plate by preferring oblong instead of square subareas; and (3) to make such a multiplicity of natural vibrations possible by multiple, small and large deformations plus additional mass inclusions into the swedged foils so that practically all the interesting frequency portions of the to be dampened sound field can be absorbed as fully as possible.

This optimizing of ten or more simultaneously excitable bending vibrations yields a greatly cleaved, rough sound absorber surface.

2. Disadvantage of the conventional foil absorbers

The above-described cupping, molding, structuring, swedging, creasing and grooving in the hitherto employed foil absorbers have a number of major drawbacks: they can hitherto only be successfully made at reasonable cost with certain polyvinylchloride-based (PVC) foils. Other plastic foils having comparable internal losses for energy dissipation of the bending vibrations do not permit these kinds of deformations.

PVC has in common with many other plastics that, even when used indoors, it is not permanently UV resistant and therefore may discolor. For environmental concerns, the market is hesitant with regard to the use of all PVC products. In some countries, fire prevention regulations prohibit the use of large amounts of PVC in buildings.

As long as thin (0.2–0.4 mm thick) foils do not tear in swedging and are not damaged during mounting as well as during maintenance, the enclosed hollow spaces which are formed permanently protect against penetration of moisture and soiling. However, the characteristic, cleaved surface nonetheless offers opportunities for deposits and soiling of all kinds in dusty, moist environments. In wet rooms, this can be counteracted to some degree by washing and brushing the grime off. However, more intensive and frequent cleaning has a negative effect on the durability of this type of foil absorber.

All these drawbacks considerably limit material selection for the fabrication of conventional foil absorbers as well as their application in the field of acoustics and the technological sound control for wall cladding and sound containment.

The object of the present invention is, therefore, to create a foil absorber that is simple to fabricate and simple to clean.

According to the present invention, these objects are achieved by a foil sound absorber having at least two smooth, plane air impermeable foils having a surface weight M of approximately 0.05 to 1 kg/m$^2$. The foils are disposed at a varying distance D from each other and from a reverberant rear wall R. This distance D between the foils being approximately 5–100 mm.

Other objects, advantages and novel features of the present invention will become apparent from the following detailed description of the invention when considered in conjunction with the accompanying drawings.

DETAILED DESCRIPTION OF THE DRAWINGS

The invented foil absorber completely prevents the cup-shaped formations and is comprised only of several (preferably 3) totally plane foils which are disposed in front of a reverberant rear wall (e.g. a very heavy component) in series (preferably all in parallel to each other and to the wall). The foils can be made of any material, e.g. plastic or metal. Its cross dimensions are largely freely selectable, e.g. corresponding to the respective case of the building which it is in. Their acoustic properties are determined according to FIG. 2 essentially by their surface weights m" and distances D to each other and to the wall. Contrary to conventional foil absorbers, the shape and formation of the hollow spaces between the foils and the wall, including the manner in which the foils are attached to spacers or to frames for attaching the absorber to the rear wall play, at least when the sound incidence is perpendicular, only a subordinate role. As the invented absorber does not essentially derive its action from the internal dampening in the foil material due to the excitation of bending deformations at folds, edges and supports, and hardly from friction between the contact surfaces or friction of vibrating airborne particles at the fine fibers or in narrow pores, regarding the selection of material and formation, it permits an adaption of the acoustic layout for the respective individual case that was previously not possible. For the layout on the same sound spectrum, it requires about the same depth and about the same surface weight as the known foil absorbers.

Figure 1A:
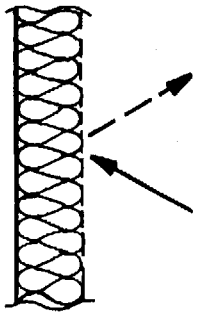
FIG. 1A PRIOR ART
FIGS. 1A–C illustrate conventionally designed absorbers for technological sound control.
Figure 1B:
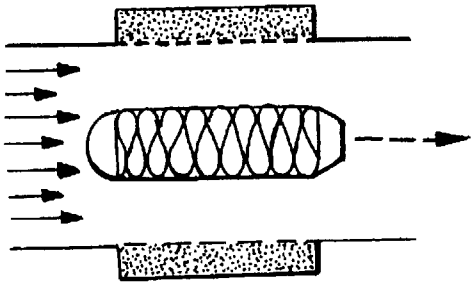
FIG. 1B PRIOR ART
Figure 1C:
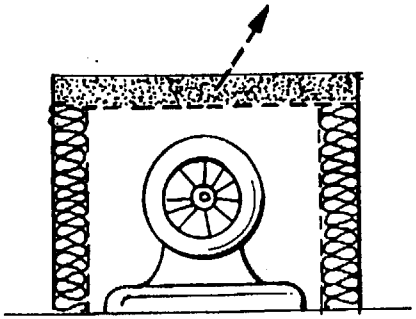
FIG. 1C PRIOR ART
Figure 2:
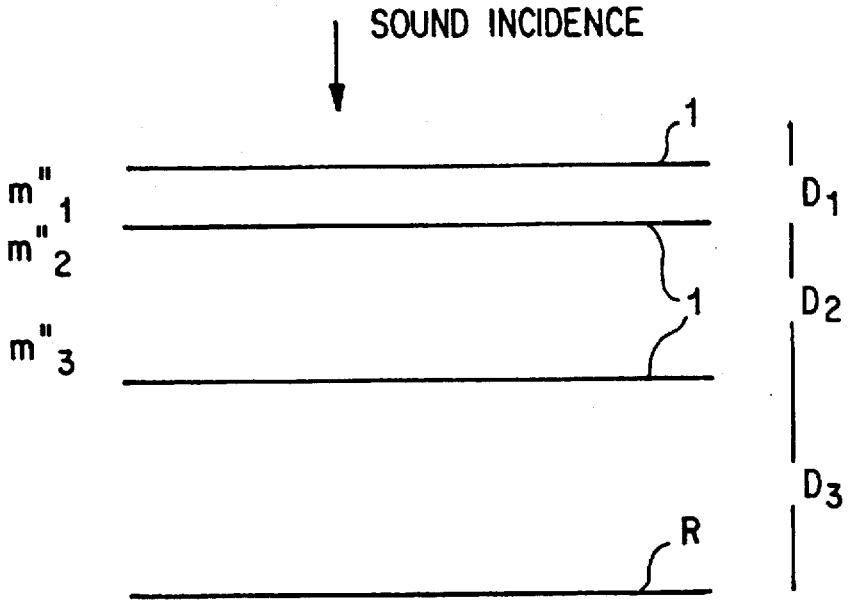
FIG. 2 is a schematic diagram of a foil absorber according to the present invention.
Figure 3A:
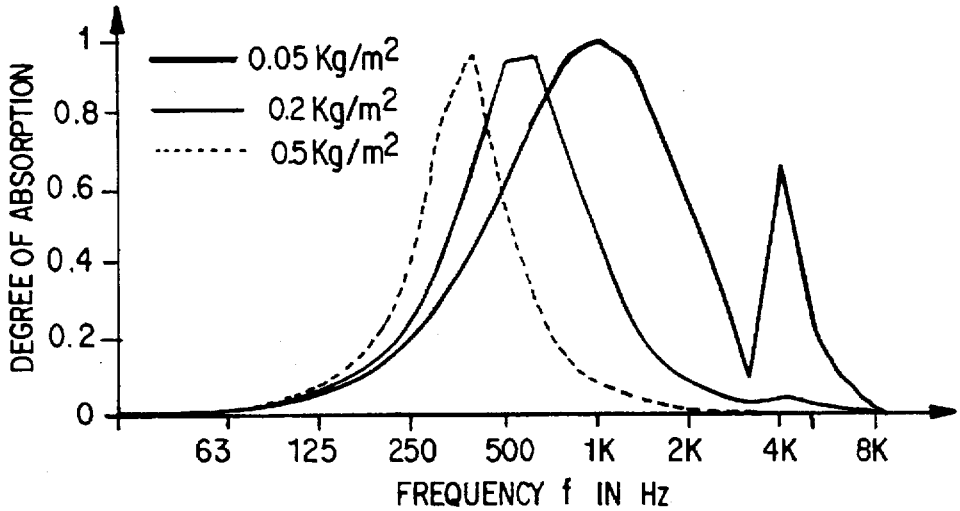
FIGS. 3A–D are graphical schematic illustrations of a simple resonance system built using only a single foil.
Figure 3B:
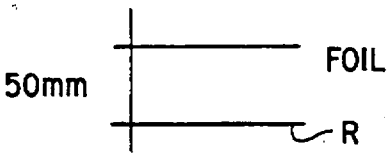
Figure 3C:
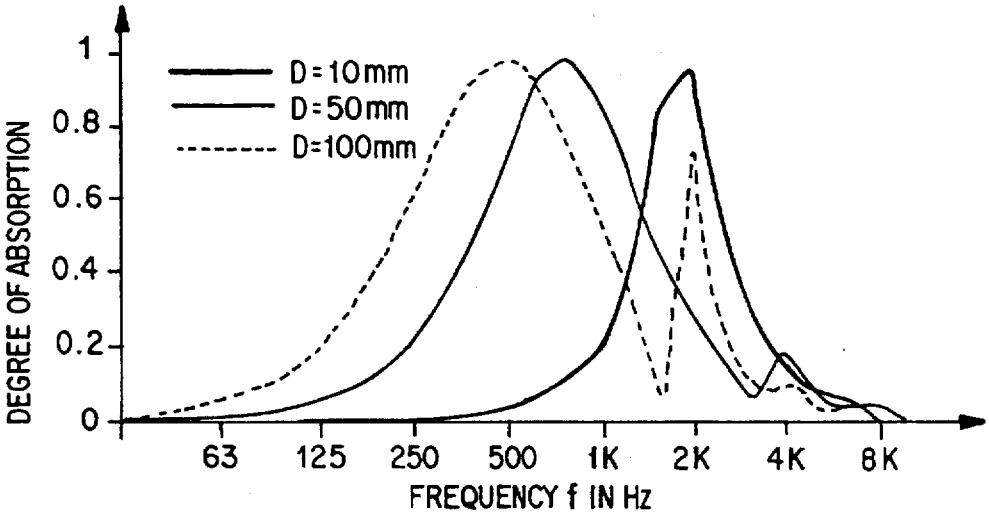
Figure 3D:
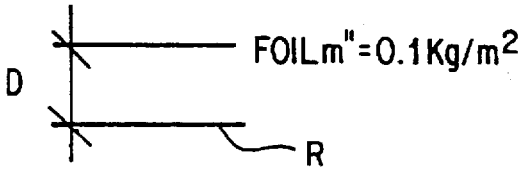

The invented foil absorber according to FIG. 2 is, similar to those according to German patent documents DE 27 58 041, DE 29 21 050 or DE 32 33 654, a complex resonance system. With its small characteristic impedance (cf. Fuchs, H.V.; Ackermann, U; Frommhold, W.: Entwicklung von nicht porosen Absorbern fur den technischen Schallschutz. Bauphysik 11 (1989), pp. 28–36), similar to the conventional foil absorbers, it already permits with a relatively small number of resonance mechanisms (preferably 3) an unanticipated wideband efficiency.

FIGS. 3A–D show an important optimizing principle of the invented absorber using the simplest example of a resonance system built of only a single foil. For a wideband dampening of high frequencies, the foil should have a small surface weight m" and not (in the case of larger m"), preferably, a correspondingly smaller distance. In order on the other hand to optimally absorb at low frequencies, not only should the surface weight be increased but also simultaneously the thickness D of the air cushion. In this way, it is possible for even the simplest one-sheet design for deep frequencies to only require distinctly less structural depth than a homogeneously designed porous or fiber absorber.

Figure 4A:
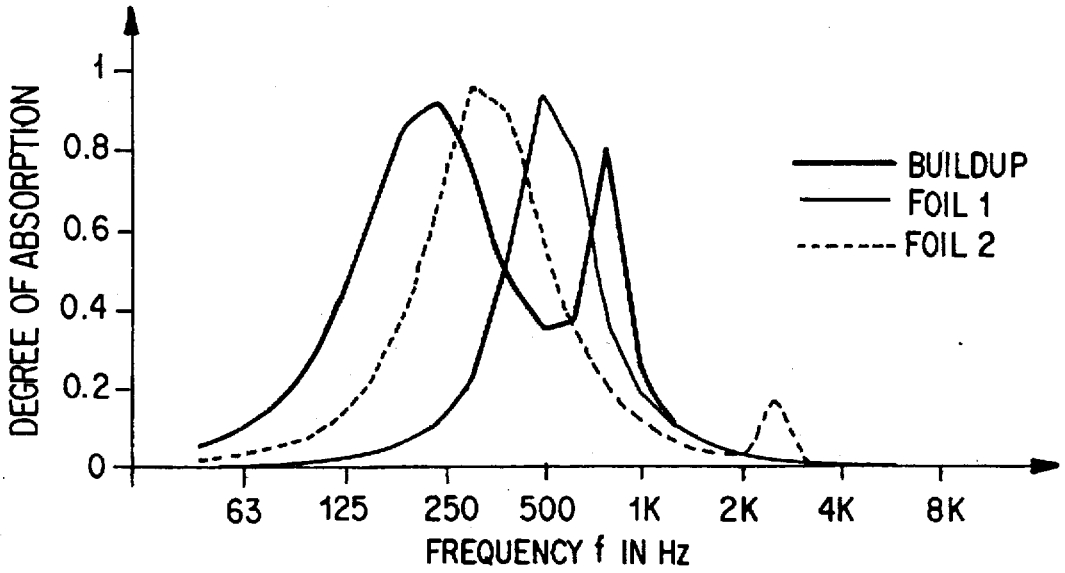
FIGS. 4A and 4B are a graphical and schematic illustration respectively, of a multi-layer foil absorber according to the present invention.
Figure 4B:
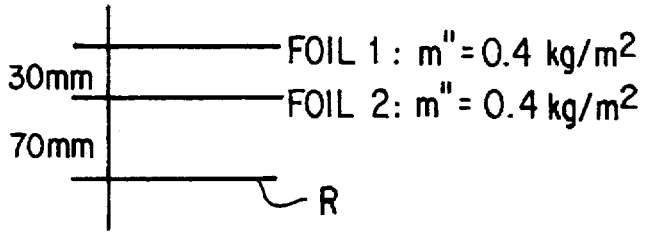

This tendency is intensified even more so in multi-layer designed invented foil absorbers. By attaching the foil 1, in addition in front of the foil 2, in FIG. 4B, the part of the dampening curves (FIG. 4A) dropping to low frequencies shifts by one to two thirds.

Figure 5A:
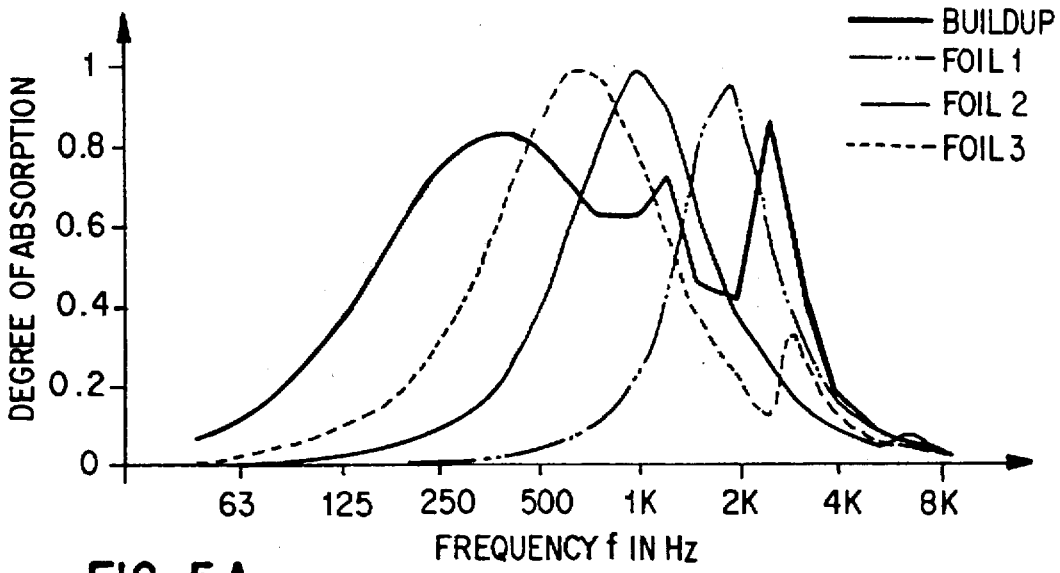
FIGS. 5A and 5B are a graphical and schematic illustration, respectively, of a foil absorber having three equally heavy foils.
Figure 5B:
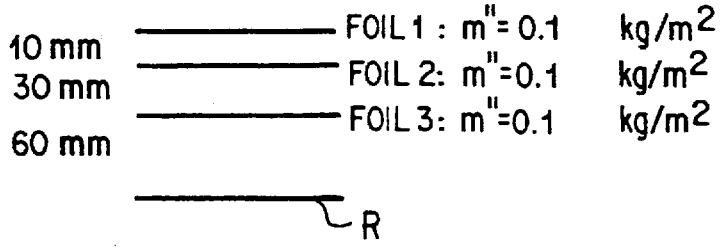
Figure 6A:
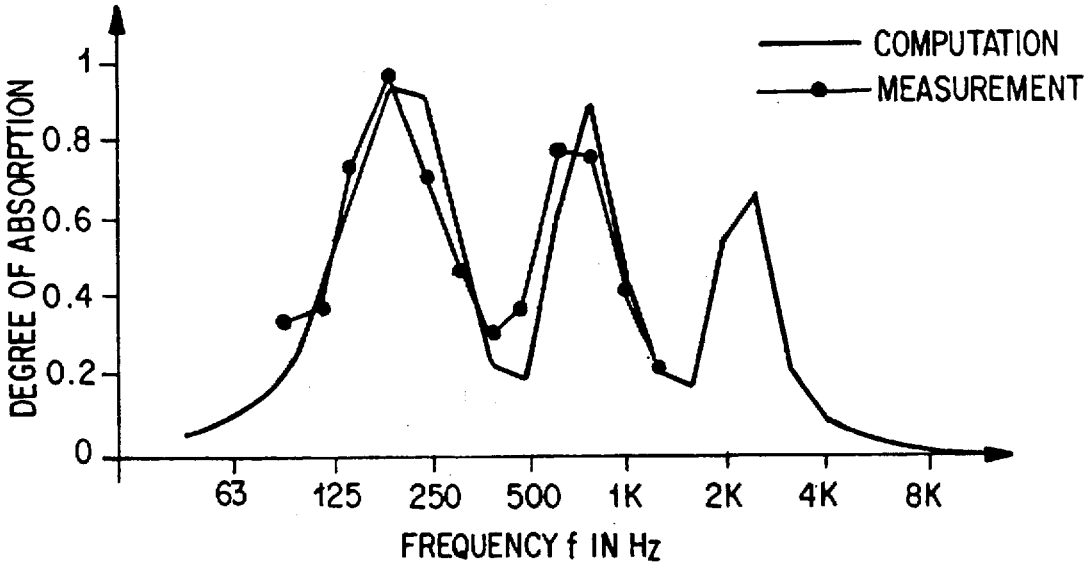
FIGS. 6A and 6B are a graphical and schematic representation, respectively, comparing computed and measured values in a so-called impedence pipe.
Figure 6B:
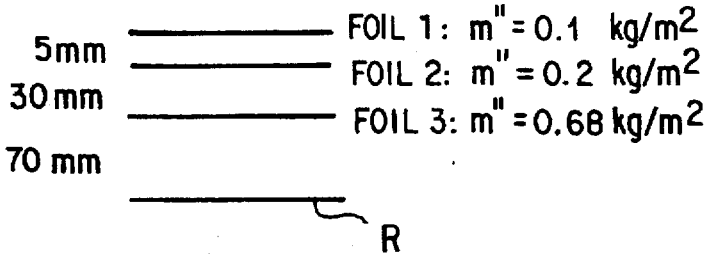

FIG. 5A shows a computer generated result for three equally heavy foils (FIG. 5B) having an overall structural depth of 100 mm. The comparison with measurements in a so-called impedance pipe having a cross section of 200×200 $mm^2$ shows very good coincidence (FIG. 6A) up to a measurement limit of 1200 Hz.

Figure 7A:
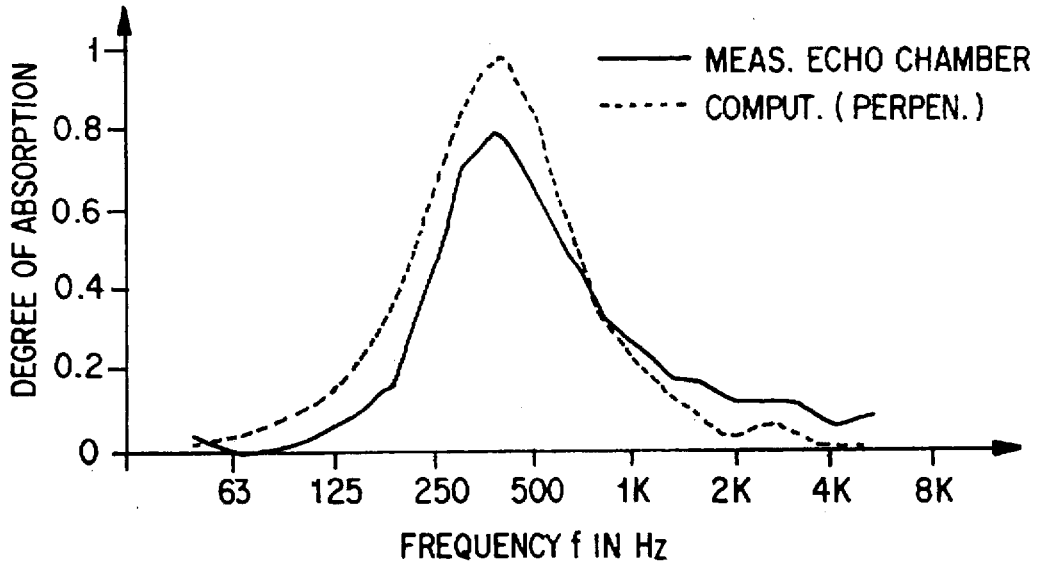
FIGS. 7A–7C are graphical and schematic illustrations of a comparison of measurements with computer results in a so-called echo chamber.
Figure 7B:
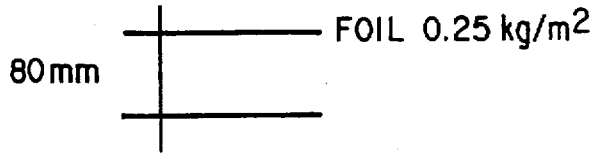
Figure 7C:
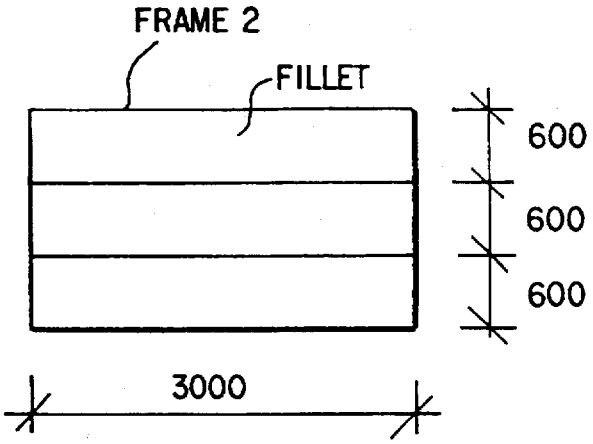
Figure 8A:
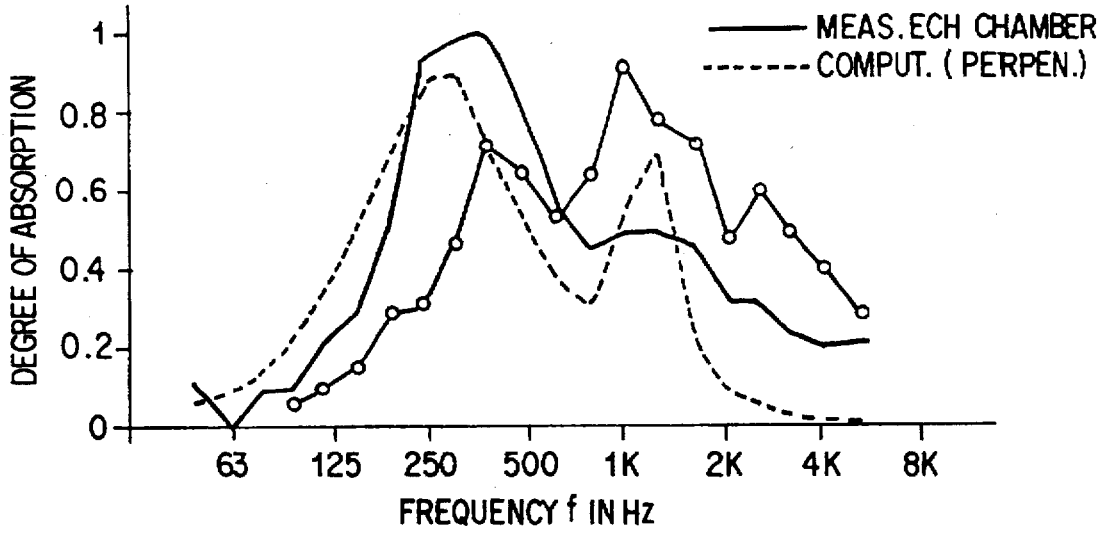
FIGS. 8A–8C are graphical and schematic illustrations of a comparison of measurements with computer results in a so-called chamber.
Figure 8B:
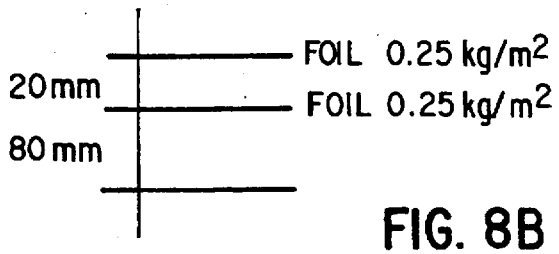
Figure 8C:
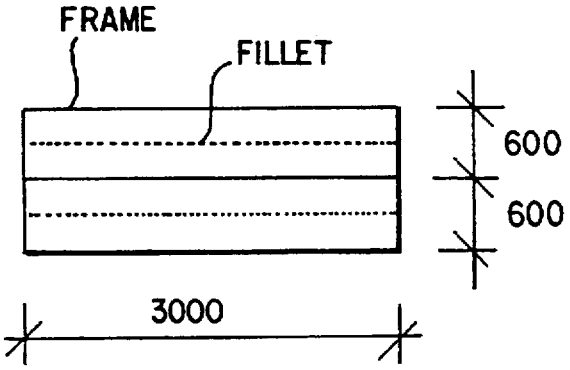

Measurements in the so-called echo chamber also follow the computer results quite well, as shown for example in FIGS. 7A and 8A.

Figure 9A:
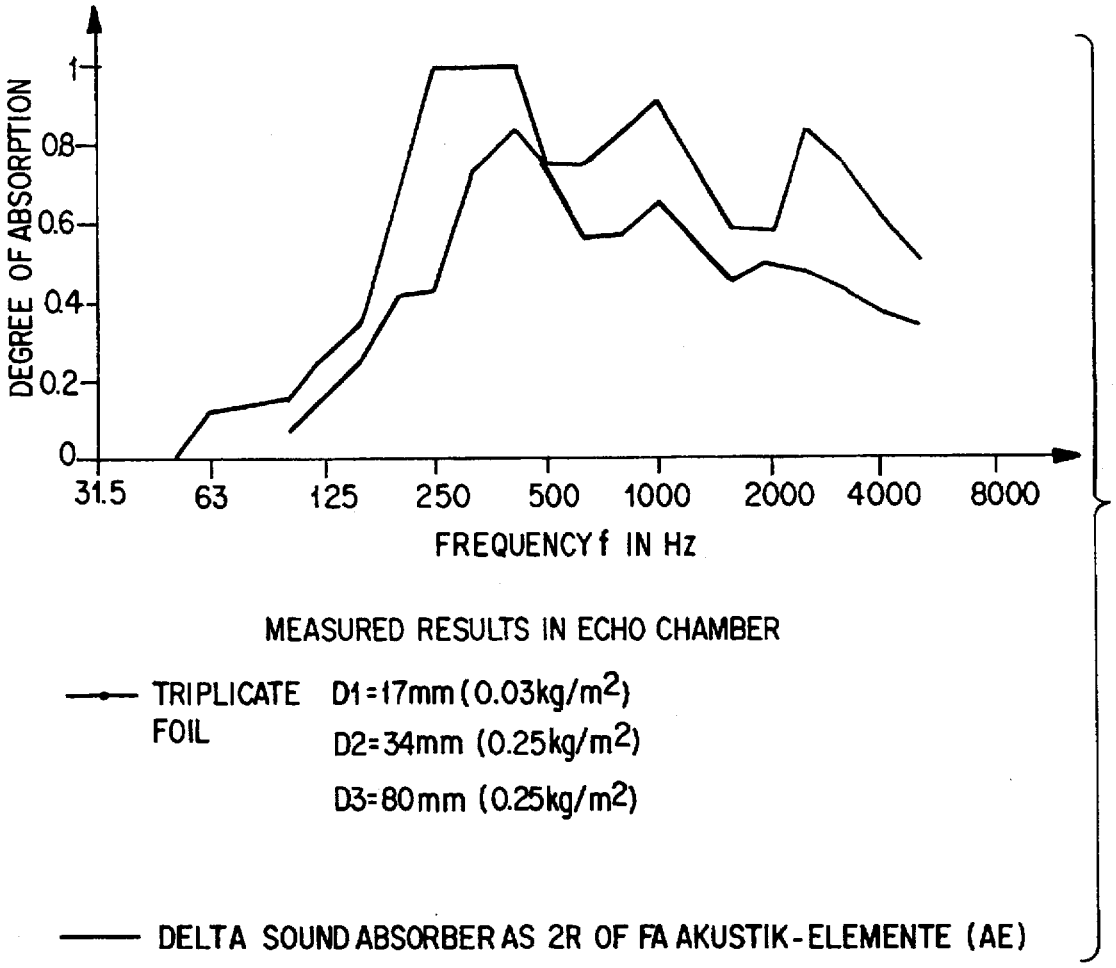
FIGS. 9A and 9B are graphical and schematic illustrations, respectively, of a comparison of two-three sheet designed foil absorbers.
Figure 9B:
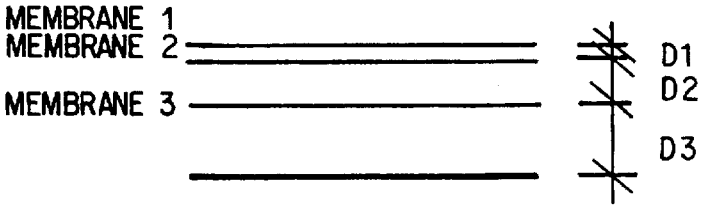

In FIG. 8A, in addition thereto, the measurement results of FIG. 2 from German patent document DE 27 58 041 for a foil absorber of approximately comparable structural depth and surface weight were plotted. The comparison of two three-sheet designed foil absorbers according approximately to FIG. 3 with A=50 mm is shown in FIG. 9A. Apparently, the deeper frequencies can be better absorbed with the invented foil absorber, whereas the higher ones can be better absorbed with the foil absorber according to German patent document DE 27 58 041.

Figure 10A:
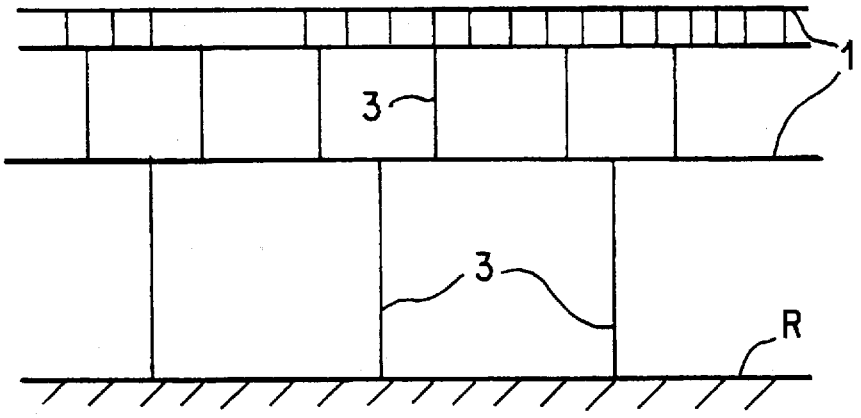
FIGS. 10A and 10B are diagrams illustrating a plane foil absorber having coffered intermediate air spaces.
Figure 10B:
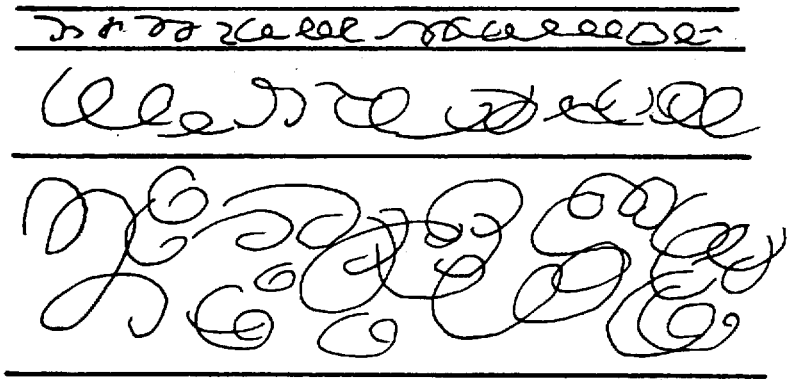

The deficiency of the plane foil absorbers regarding oblique sound incidence generally predominating in echo chambers as well as in large rooms can be compensated by means of simple coffering of the large surfaced air cushions. Moreover, it is necessary that the intermediate air spaces according to FIGS. 10A and 10B are divided by a uniform (FIG. 10A) (e.g. honeycomblike) or non-uniform (FIG. 10B) (e.g. made of crunched foil) grid structure in such a manner that subareas the size of a few centimeters are created. The coffering can occur by means of intermediate walls made of plastic or metal. However, the foils should not touch or lie on the internal coffers. The coffering can be suspended or attached to the side borders of the foil absorber itself. Such an optimization at high frequencies is known from, e.g. glancing incident sound in sound damper valves in flow canals, which are therefore designed to be "coffered" on the interior. It is pointed out that frequently sound absorbers are called for in order to minimize impairing reflections in acoustics, which absorbers in particular can absorb the approximately perpendicular striking sound waves.

The invented foil absorbers can be made to be practically randomly wideband absorbing by means of mass/spring systems disposed in a staggered relationship in series and composed of thin foils having intermediate air spaces, in particular, if one raises (in the direction of sound incidence) the weight surface m" of the foils and also increases the distances D between the foils in the direction to the wall.

It is especially advantageous if the hollow space resonator formed by the foil 1, the lateral frames 2 or spacers and the rear wall R is designed in a gastight manner.

If, for instance, glass clear foils of acrylic glass having a thickness of approximately 0.1 to 0.5 mm are selected, a completely transparent absorber can be designed, which, at least in the case of perpendicular sound incidence, can optimally absorb the entire frequency range that is important for understanding language. (For frequencies above 1–2 kHz, there is usually sufficient absorption in multi-purpose rooms for language and music due to the interior decoration of the audience. Compared to the plastic component according to German patent document DE 43 15 759 with its micro-perforated hole plate as the sound absorber, the invented foil absorber can be designed acoustically more wideband and significantly less expensively and, due to the closed surface, so as to be easier to maintain.

On the other hand, if mechanically and chemically heavy-duty foils of plastics, metal or composite materials are selected, a very robust and wideband absorber for technological sound control obviating sensitive fibrous or porous materials can be designed.

The flat, completely plane and smooth construction of the invented foil absorber offers substantial advantages regarding deposits and cleaning.

Compared to membrane absorbers according to German patent document DE 34 04 208 with its complicated substructure of hollow chambers that are sealed from each other, the plane foil absorber can be fabricated significantly cheaper and less expensively.

As it is free of any specific grid as a subconstruction or frame, the invented foil absorber, like sound dampeners made of homogeneous mineral wool, can be built as a sound absorbing component having the required rigidity with any prefabricated elements and fabricated in modules preferably in conjunction with a reverberant rear wall, as well as in any dimensions.

Another embodiment, e.g., for indoor swimming pools, can receive a thin, water-impermeable cloth as the first foil facing the room. An especially robust variant can use a new, extremely tear-resistant, thin synthetic fabric as the first foil.

The invented foil absorber offers a variety of coloring and surface structure hitherto unknown for sound absorbers, which is beneficial for its use in acoustics.

What is claimed is:

1. A foil sound absorber, comprising:

a reverberant rear wall; and at least two smooth, planar air impermeable foils having respective surface weights m" of approximately 0.05–1 $kg/m^2$, said foils being disposed in series with said rear wall at a varying distance D from each other as well as a varying distance from said reverberant rear wall R, said varying distance D between said at least two foils being approximately 5–100 mm.

2. The foil sound absorber according to claim 1, wherein said surface weights of said at least two foils increase toward said reverberant rear wall, and wherein said at least two foils are disposed with an approximately equally increasing distance toward the reverberant rear wall.

3. The foil sound absorber according to claim 1, further comprising:

one of spacers and frames, said one of said spacers and frames being made of at least one of a metal, plastic, and a composite material; and wherein outer edges of said at least two foils are attached to said one of spacers and frames.

4. The foil sound absorber according to claim 1, wherein at least one of said foils has a surface area of approximately 0.1 to 1 $m^2$ which is suspended in free manner.

5. The foil sound absorber according to claim 1, wherein said at least two foils are made of one of plastic, acrylic glass, metal, and composite materials.

6. The foil sound absorber according to claim 1, wherein intermediate air spaces between said at least two foils are coffered in one of a uniform and non-uniform manner, internal ones of said coffers not hindering any of said at least two foils when vibrating; and wherein said coffering prevents sound propagation in said intermediate air spaces;

wherein walls of said internal ones of said coffers are designed in a rigid manner and of the same materials.

7. The foil sound absorber according to claim 3, wherein intermediate air spaces between said at least two foils are coffered in one of a uniform and non-uniform manner, internal ones of said coffers not hindering any of said at least two foils when vibrating; and wherein said coffering prevents sound propagation in said intermediate air spaces;

wherein walls of said internal ones of said coffers are designed in a rigid manner and of different materials.

8. The foil sound absorber according to claim 1, wherein one of said at least two foils remote from said rear wall is made of one of a water-impermeable fabric, cloth and synthetic fabric.

9. The foil sound absorber according to claim 8, wherein said one foil is at least one of dyed and printed.

10. The foil sound absorber according to claim 3, wherein a hollow space formed between said foils, a frame and said rear wall is a gastight hollow space.

* * * * *